United States Patent [19]

Farina et al.

[11] Patent Number: 4,854,375

[45] Date of Patent: Aug. 8, 1989

[54] OVERHANGING BLOW-CONVECTOR FOR INDOOR SPACE AIR-CONDITIONING

[75] Inventors: Daniele Farina, Monza; Guglielmo Colombo, Casatenovo; Lorenzo Bonfanti, Usmate, all of Italy

[73] Assignee: Delchi/Carrier S.p.A., Milan, Italy

[21] Appl. No.: 71,171

[22] Filed: Jul. 8, 1987

[30] Foreign Application Priority Data

Jul. 16, 1986 [IT] Italy ..... 2254586[U]

[51] Int. Cl.[4] ..... F24D 5/10

[52] U.S. Cl. ..... 165/53; 165/125; 62/263; 62/DIG. 16

[58] Field of Search ..... 165/125, 55, 53; 62/DIG. 16, 263; 237/46, 49; 126/110 B, 110 D

[56] References Cited

U.S. PATENT DOCUMENTS

| | | | |
|---|---|---|---|
| 1,790,473 | 1/1931 | Hart et al. | 237/49 X |
| 2,275,295 | 3/1942 | Greenway | 165/109.1 X |
| 2,486,145 | 10/1949 | Frie | 165/125 X |
| 2,516,871 | 8/1950 | Haugen | 165/55 X |
| 2,526,243 | 10/1950 | Lange | 165/125 |
| 2,631,825 | 3/1953 | Zeitler | 165/55 |
| 2,633,718 | 4/1953 | Wile | 165/124 |
| 2,773,364 | 12/1956 | Zipser | 165/125 X |
| 2,855,185 | 10/1958 | Runte | 165/55 |
| 3,341,689 | 9/1967 | Reichenbach | 165/122 X |
| 4,553,584 | 11/1985 | Bloomquist | 165/42 X |
| 4,664,179 | 5/1987 | Yokoyama | 165/125 X |

*Primary Examiner*—Ira S. Lazarus
*Assistant Examiner*—Richard R. Cole
*Attorney, Agent, or Firm*—Birch, Stewart, Kolasch & Birch

[57] ABSTRACT

A blow convector for indoor space air conditioning which can be installed in a room while maintaining its walls fully available for other uses, the blow convector having segmental shape with a base substantially in the form of a circular segment and having an arcuate front.

5 Claims, 1 Drawing Sheet

12a
12a
12
3
2b
7
2a
11
9
2b
III
10
13
7a
11
7
16
1
8
17
18
III
15
7
2a
4
1
5
4
21
3
6
7b
12a
7b
7
7a
10
2a,b
14
13a
16
15
1
II
II
11
11a
13
7a
4
20
5
19

OVERHANGING BLOW-CONVECTOR FOR INDOOR SPACE AIR-CONDITIONING

BACKGROUND OF THE INVENTION

The present invention relates to a blow-convector for indoor space air-conditioning, of a type which comprises at least one suction port and at least one delivery port formed in a box-type structure, as well as a blower and a heat exchanger supported within the box-type structure.

Such blow-convectors, which have usually a parallelepipedic shape, are commonly employed for air conditioning of dwellings and offices and generally floor-mounted close against a wall.

While generally satisfactory, such conventional blow-convectors have the disadvantage that they are difficult to position and thus may be in the way unless they can be installed at some suitable locations, e.g. underneath a window.

To overcome this problem, it has been suggested to mount conventional blow-convectors on a wall or the ceiling, but even these prior approaches have disadvantages. In act, with a wallmounted blow-convector, the possibility is restricted, or even precluded, of using the wall for the location of items of furniture, bookcases, or pictures. On the other hand, overhead blow-convectors are only advantageous where false ceilings are provided above which the electric lines, ducting for the heat exchanger working fluid, and condensation water discharge conduits can be conveniently laid.

SUMMARY OF THE INVENTION

It is the object of the present invention to provide a blow-convector as indicated which has such constructional and operational features as to enable the prior problems outlined above to be obviated.

This object is achieved by a blow-convector as indicated, which is characterized in that the box-type structure has a segmental shape.

BRIEF DESCRIPTION

Further features and the advantages of a blow-convector according to the present invention will become apparent from the following description of a preferred embodiment thereof, given here by way of illustration and not of limitation with reference to the accompanying drawings.

DETAILED DISCUSSION

Figures 1, 2, 3:
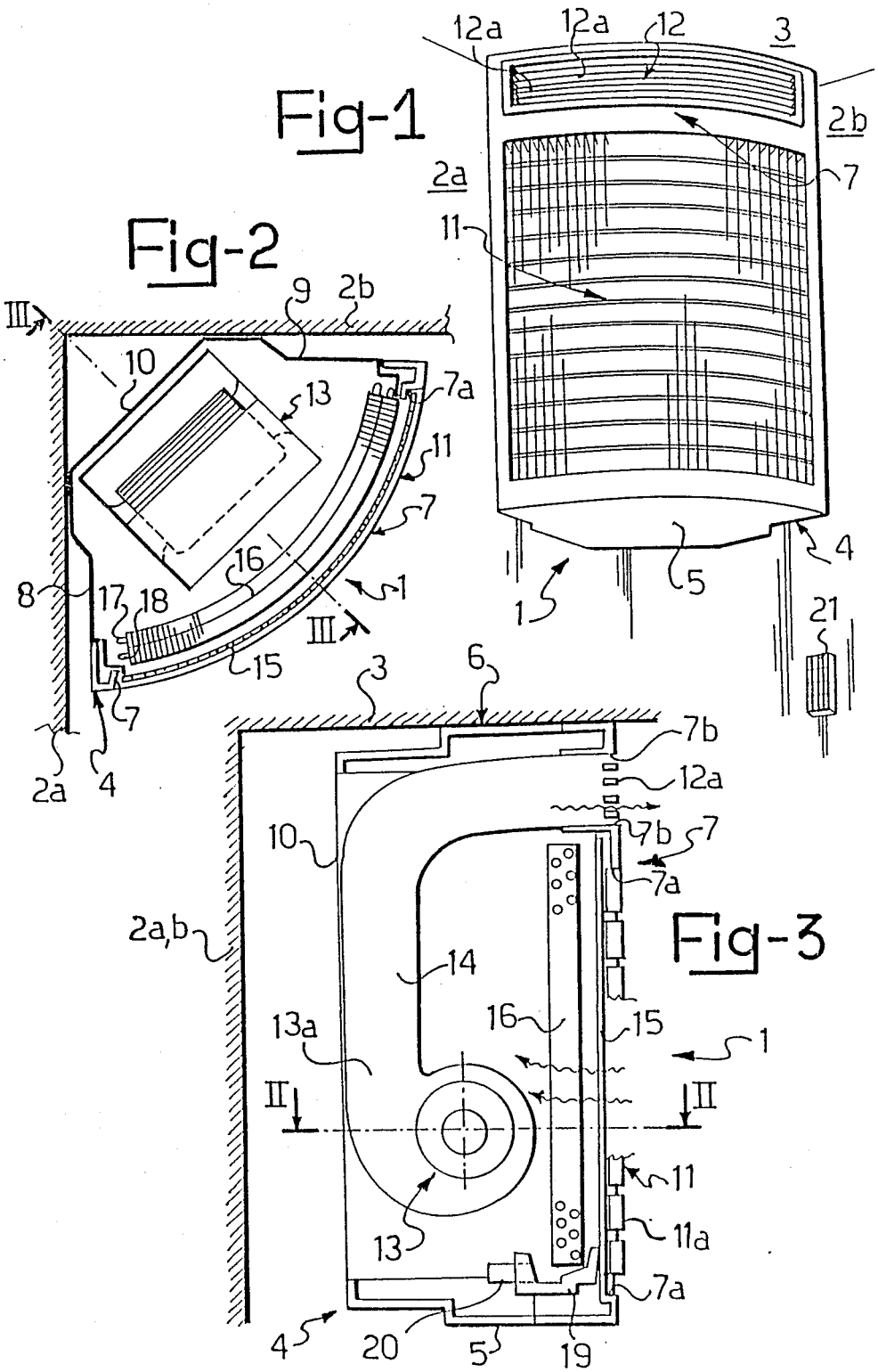
FIG. 1 is a perspective view of a blow-convector according to the invention.
FIG. 2 is a schematical view showing, in plan and in section, the blow-convector of FIG. 1, as taken along the line II—II.
FIG. 3 is a schematical sectional view of the blow-convector of FIG. 1 taken along the line III—III.

With reference to the drawing figures, generally designated 1 is a blow-convector according to the present invention for indoor space air-conditioning applications, which is intended for hanging in a corner of a room between two adjoining walls, *2a* and *2b*. In particular, in the example considered, the blow-convector 1 would be advantageously placed close against a ceiling 3 of the room.

The blow-convector 1 comprises a box-type structure 4 of segmental shape and having parallel-laid opposed bases, respectively a bottom one 5 and an upper one 6 substantially in the form of a right circular segment having an arcuate front 7.

Indicated at 8 and 9 are two sidewalls adjoining the front 7 and converging toward each other at right angles.

The sidewalls 8 and 9 and the top base 6 are intended for placement close against the walls *2a,2b* and the ceiling 3, respectively, being held fast thereto by anchoring means not shown in the drawings.

Advantageously, the box-type structure 4 would be formed with a rear bevel 10, on the remote side from the front 7.

In the structure 4, and at the front 7, there are formed two ports with substantially rectangular cross-sectional shapes which span most of the front 7; one of such ports, i.e. the suction port *7a*, is formed in the vicinity of the bottom base 5 and has a larger size than the other, i.e. the delivery port *7b* which is formed in the vicinity of the top base 6.

The suction port *7a* and delivery port *7b* are fitted with grids, respectively a suction one 11 and a delivery grid 12. In particular, the delivery grid 12 comprises a plurality of parallel vanes *12a*, advantageously of the adjustable inclination type.

The numeral 13 designates generally an electric blower supported within the box-type structure 4, the electric blower 13 having its intake side at the suction port *7a* and its exhaust side at a delivery outlet *13a* thereof.

A delivery duct 14 extends within the blow-convector 1 and has one end connected to the delivery outlet *13a* of the electric blower 13, and an opposite end open to the exterior of the blow-convector 1 at the delivery port *7b*.

An air filter 15 is supported peripherally on the box-type structure 4 at the suction port *7a*, close against the grid 11.

According to the present invention, the blow-convector 1 further comprises a heat exchanger 16, carried within the box-type structure 4 close to the filter 15; the heat exchanger 16, which in the example shown is a finned fluid-evaporation or chilled water bank, is arranged to be swept by the intake air flow to the electric blower 13 through the suction port *7a* and the filter 15.

The heat exchanger 16 is provided with two fittings 17 and 18 for connection to fluid supply conduits, not shown, to the heat exchanger.

Indicated at 19 is a condensation water collecting pan mounted within the box-type structure 4 on the bottom base 5 at the heat exchanger 16. The pan 19 is equipped with a fitting 20 for connection to a conduit for discharging condensation water formed and collected in the pan 19.

Indicated at 21 is a box adapted for installation at a conveniently accessible location on the wall *2b*. It accommodates conventional remote control means, preferably associated with a thermostat, for remote controlling the blow-convector 1.

Operation of the blow-convector 1 of the present invention, as controlled from the remote control means, begins with the intake, by the electric blower 13, of an air stream to be conditioned. That air stream enters the box-type structure 4 through the suction port *7a* undergoes filtering through the air filter 15, to then sweep past the heat exchanger 16 and flow out back to the room to be air-conditioned, at a set temperature, through the duct 14 and the delivery port *7b*.

The blow-connector of the present invention affords the important advantage that it can be installed indoors and yet permit maximum freedom of utilization of walls. In fact, by virtue of its segmental configuration, it may be placed in a corner area, preferably close against the ceiling.

It should be further noted that the processed airflow exiting the blow-convector through the delivery port in the arcuate front, is apt to sweep smoothly across the entire ceiling, to then "overfall" into the space to be conditioned.

An added and not lesser advantage of the inventive blow-convector resides in its attractive outward appearance, which can harmonize well with the remaining elements of the indoor space accommodating it.

The invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed:

1. A blow-convector for indoor space air-conditioning which comprises a box-type structure, including parallel bottom and top bases, having a substantially right circular segmental shape, with an arcuate front adjoining two sidewalls converging toward each other at right angles, a suction port and a delivery port formed in said arcuate front of said box-type structure, and a blower and heat exchanger supported within said box-type structure.

2. A blow-convector according to claim 1, wherein said heat exchanger is located at said suction port.

3. A blow convector according to claim 2, wherein said delivery port and said suction port extend over the entire front.

4. A blow convector according to claim 3, wherein said delivery port and said suction port are superimposed.

5. A blow convector according to claim 2, wherein said suction port is formed in the vicinity of said bottom base and said delivery port is formed in the vicinity of said top base.

* * * * *